United States Patent [19]

Alexander, III

[11] 4,390,139

[45] Jun. 28, 1983

[54] OSCILLATING GUIDE ROLL ASSEMBLY FOR CLOTH WINDER

[76] Inventor: William J. Alexander, III, 41 W. Golden Strip Dr., Mauldin, S.C. 29662

[21] Appl. No.: 290,612

[22] Filed: Aug. 6, 1981

[51] Int. Cl.[3] ..... B65H 17/08; B65H 17/12; D03D 49/20

[52] U.S. Cl. ..... 242/66; 242/55; 242/67.1 R; 139/304; 139/306

[58] Field of Search ..... 242/62, 55, 76, 67.1 R, 242/67.3 R, 66; 139/304, 307, 308, 313, 306

[56] References Cited

U.S. PATENT DOCUMENTS 2,130,332 9/1938 Davis ..... 242/67.1 R
2,353,653 7/1944 Croft et al. ..... 242/76
2,485,705 10/1949 Croft et al. ..... 242/76 X
2,903,195 9/1959 Penland et al. ..... 242/67.2
4,252,154 2/1981 Alexander ..... 242/66 X

FOREIGN PATENT DOCUMENTS 530496 12/1972 Switzerland ..... 139/306

*Primary Examiner*—Stuart S. Levy
*Assistant Examiner*—Scott J. Haugland
*Attorney, Agent, or Firm*—Harry I. Leon; V. L. Leon

[57] ABSTRACT

An oscillating guide roll assembly is illustrated for use with a cloth winder in building a cloth roll in such a manner as to avoid registry of the selvage portions throughout the build of the cloth roll. The subject oscillating guide roll is especially useful in connection with looms such as Sulzer looms having thickened edge portions which result from inserted filling ends in the selvage area.

3 Claims, 3 Drawing Figures

OSCILLATING GUIDE ROLL ASSEMBLY FOR CLOTH WINDER

BACKGROUND OF THE INVENTION

This is an improvement upon the oscillating roll illustrated in U.S. Pat. No. 4,252,154 wherein axial oscillations are imparted through a mechanical linkage means to a guide roll. Such a structure is illustrated as including a worm gear, resulting in a geared down oscillating of the roll. The disclosure of U.S. Pat. No. 4,252,154 is incorporated herein by reference.

It is an important object of this invention to provide a simplified mechanism for oscillating a guide roll in a cloth winder and the like.

SUMMARY OF THE INVENTION

It has been found that a simplified oscillating guide roll assembly may be provided for use with a cloth winder wherein the guide roll is turned by the cloth passing thereover for winding while a shaft supporting the guide roll is driven in the same direction by a power take-off arrangement from the drive means of the winder. A camming mechanism is positioned between the cloth roll and the shaft, which is slidable with respect to the guide roll and driven by the winder so as to provide oscillatory movement. Such a cam mechanism is illustrated as being positioned at both ends of the roll, however, a suitable return mechanism may possibly be provided at one end of the roll. The shaft is driven at a differential speed somewhat more or less by a predetermined amount so as to result in the provision of a limited number of oscillations. Approximately one oscillation per ten yards of fabric has been found to be satisfactory although other rates may be utilized.

BRIEF DESCRIPTION OF THE DRAWINGS

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

The drawings illustrate an assembly including an oscillating guide roll over which the cloth passes prior to its passage to the takeup roll of a loom cloth winder. A tubular roll member A is aligned transversely of the passage of a web in the form of a width of cloth W in contact with the cloth as it comes to the winder. Means include mounting a shaft B for carrying the tubular roll for rotation responsive to the contact with the cloth and for longitudinal sliding movement between the shaft and the roll. Means C are provided for driving the tubular roll at a predetermined speed differential to, and in the same direction of rotation of the tubular roll. Suitable cam means D exerts a longitudinal force between the tubular roll, and the means mounting the tubular roll imparting an oscillatory movement to the tubular roll in accordance with the speed differential. The cam means D includes an inclined cam member fixed in respect to the tubular roll, and a cam follower carried by the means mounting the tubular roll.

Figure 1:
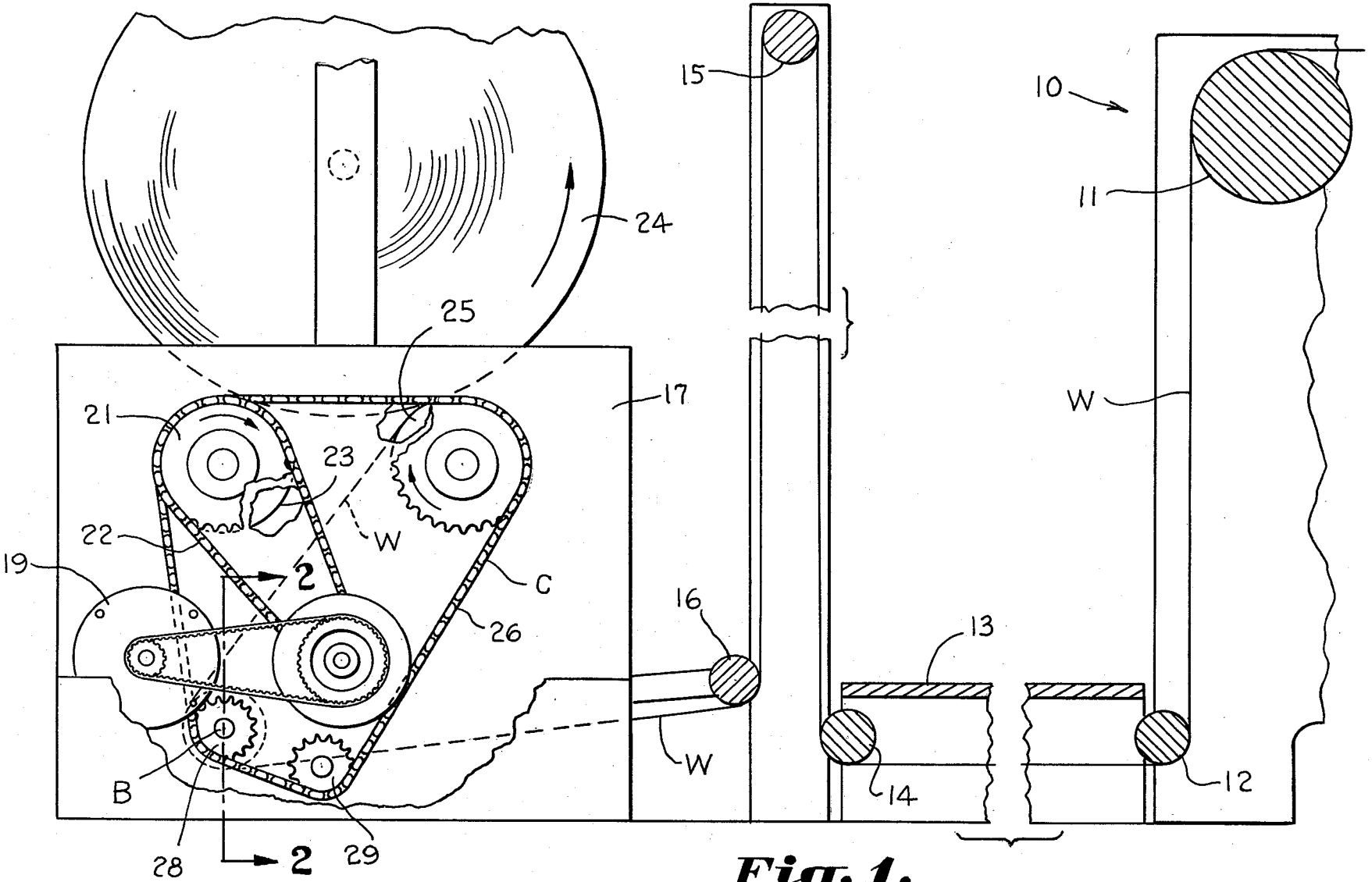
FIG. 1 is a longitudinal sectional elevation illustrating a loom equipped with an oscillating guide roll assembly for use with a surface wound take-up winder.

Referring more particularly to FIG. 1, a loom is broadly designated at 10 having a roll 11 over which the finished cloth W is fed in open width over a roll 12 for guiding a width of cloth beneath a platform 13 to a roll 14 for delivery for inspection over an elevated roll 15. The web W is then fed downwardly over a dancer roll 16 to the guide roll A with which the present invention especially concerns itself. If desired, the guiding of the cloth may be accomplished differently, and the guide roll to be oscillated may be arranged in another desired sequence for imparting the desired oscillating capability to the cloth or other form of web W, which is illustrated as being delivered in this instance to the winder in a surface wound configuration. If desired, the oscillated roll A may be substituted for the second of the guide rolls which has been designated at 14 and other but similar guide means provided for the cloth in its passage to the winder.

Figure 2:
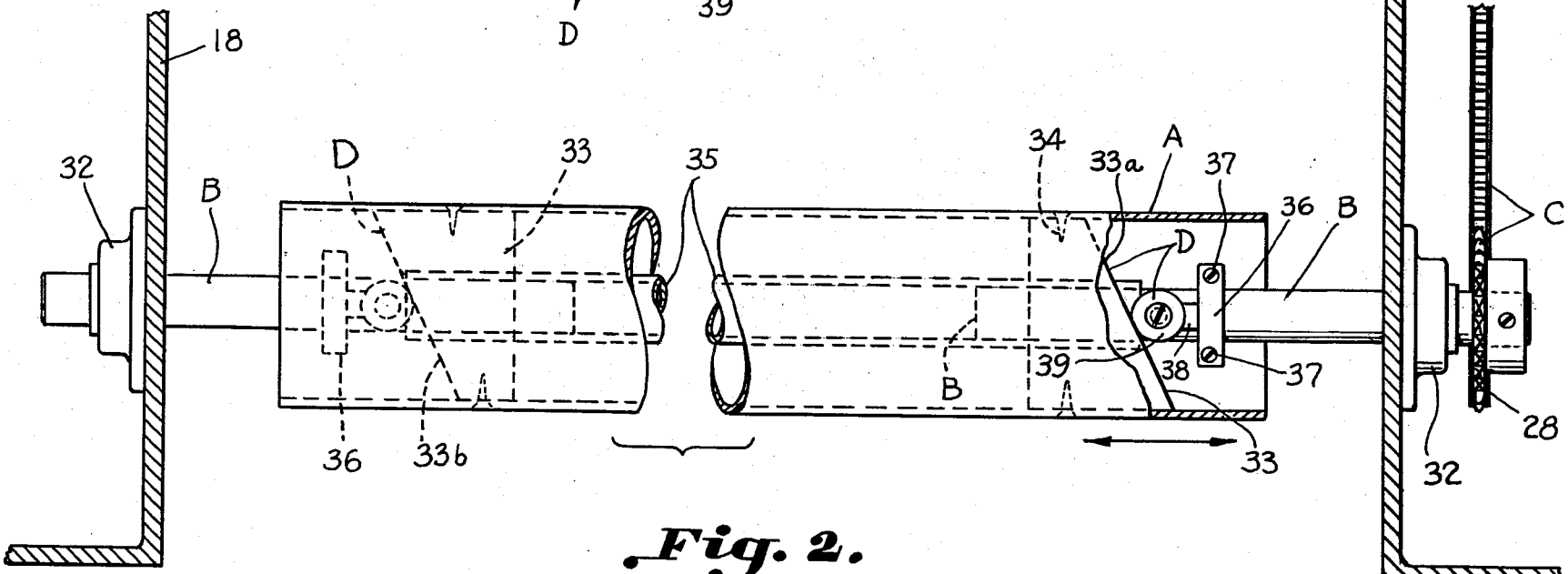
FIG. 2 is a transverse sectional elevation taken on line 2—2 in FIG. 1.

The winder is illustrated as having end frame members 17 and 18 (FIGS. 1 and 2). The winder includes a motor 19 which drives a sprocket 21 through a suitable speed regulator. A chain 22 drives one of the support rolls 23 upon which the cloth roll 24 is built. The other support roll is illustrated at 25, and is driven through the chain 26. The chain 26 also drives the sprocket 28 which, together with the chain 26, forms a part of the drive C referred to above. An idler 29 is provided for maintaining proper tension on the chain.

Figure 3:
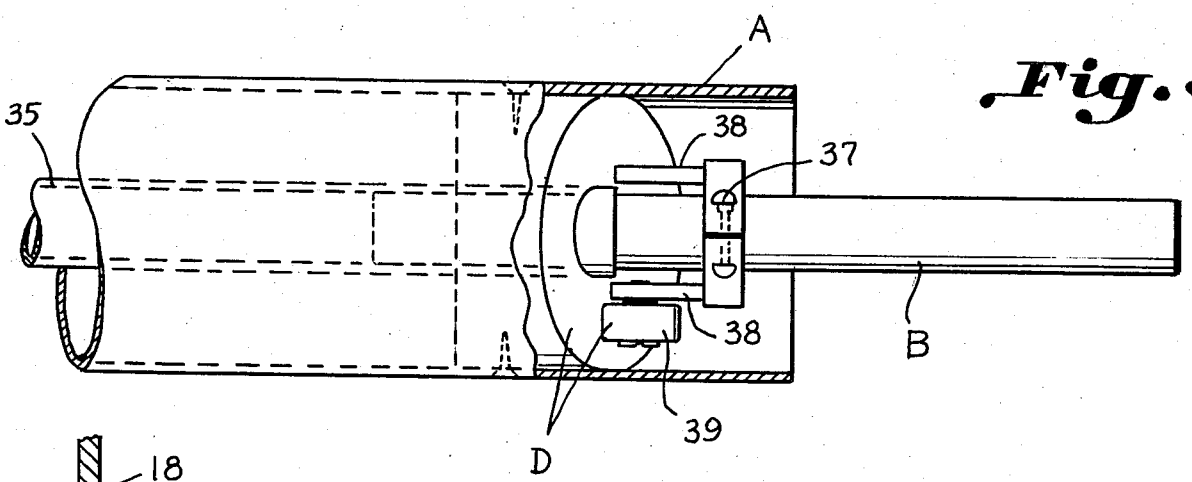
FIG. 3 is an enlarged front elevation with parts broken away illustrating the cam mechanism imparting oscillatory motion to the roll.

Referring more particularly to FIG. 2, a pair of shafts B are carried in respective ends of the tubular guide roll A, which is illustrated in the form of a shell. The shafts B are carried in bearings 32 outside the frame members 17 and 18. On each of the other ends, the shafts B are slidably mounted within blocks 33 which are fixed as by screws 34 within the tubular roll A. Each of the free ends of shaft B are inserted into tubular connecting shaft 35 which is slidable within the blocks 33. A collar 36 which is tightenable about the shaft by the screws 37 carries a pair of brackets 38 (FIGS. 2 and 3). One of the brackets 38 carries a roller bearing 39 which serves as a cam follower in engagement with the inclined surface 33*a* of the right hand end of the roll A. An opposite inclination is given an inclined cam surface D carried at an opposite end of the roll.

Any suitable alternate method of mounting the cam follower 39 may be provided as where a collar has projections extending radially outwardly thereof for carrying a roller bearing on either side thereof.

The blocks 33 may assume any suitable form and a wooden block would be entirely satisfactory. The axial opening within the block to accommodate the shaft B does not require the use of a sleeve, which is illustrated in the drawings, although such may be desirable. By driving the shaft on which the shell is rotatably mounted, in the same direction that rotation is imparted to the shell by cloth friction at a slight speed differential one way or the other, it may be seen that this differential will control the frequency of oscillation of the roll. Oscillation is imparted to the roll by the cam means wherein the follower is carried by and in respect to the shaft, and the cam surface is carried by and in respect to the roll shell.

It is thus seen that a less expensive oscillatory roll is provided for use with a web takeup such as cloth from a loom which may be driven from the takeup at a relatively low or reduced frequency of oscillation. The structure is more compact and more easily serviced, and as illustrated, the structure is enclosed within the operating mechanism of the takeup. The device is especially useful where thickened edges of the web must be accommodated in a built up roll, such as where cloth has a tucked selvage or a greater thickness of yarn in the selvage portion.

While a preferred embodiment of the invention has been described using specific terms, such description is for illustrative purposes only, and it is to be understood that changes and variations may be made without departing from the spirit or scope of the following claims.

What is claimed is:

1. For use in a cloth winder having a driven cloth takeup roll, an assembly including an oscillating guide roll over which said cloth passes prior to the takeup roll comprising:

a tubular roll member aligned transversely of the passage of a width of cloth in contact with the cloth as it comes to the winder;

means mounting said tubular roll for rotation responsive to said contact with the cloth and for longitudinal sliding movement between said tubular roll and said mounting means;

means driving said mounting means at a predetermined speed differential to and in the same direction of rotation of the tubular roll; and cam means between said tubular roll and said mounting means for imparting an oscillatory movement to said tubular roll relative to said mounting means in accordance with the speed differential.

2. The structure set forth in claim 1 wherein said cam means includes:

an inclined cam member fixed in respect to said tubular roll; and a cam follower carried by said means mounting said tubular roll.

3. The structure set forth in claim 2 wherein said means mounting said tubular roll is a shaft slidably mounted in said inclined cam member within said tubular roll.

* * * * *

UNITED STATES PATENT AND TRADEMARK OFFICE

CERTIFICATE OF CORRECTION

PATENT NO. : 4,390,139

DATED : June 28, 1983

INVENTOR(S) : William J. Alexander. III

It is certified that error appears in the above-identified patent and that said Letters Patent is hereby corrected as shown below:

On the title page, attorney, agent or firm should read

-- Ralph Bailey --.

Signed and Sealed this

*Seventh* Day of *February 1984*

[SEAL]

*Attest:*

GERALD J. MOSSINGHOFF

*Attesting Officer*

*Commissioner of Patents and Trademarks*